US005645688A

United States Patent [19]

Payton et al.

[11] Patent Number: 5,645,688

[45] Date of Patent: Jul. 8, 1997

[54] BLEACHING COMPOSITIONS AND PROCESSES EMPLOYING SULFAMATES AND POLYAMINOCARBOXYLIC ACIDS

[75] Inventors: James H. Payton, Marietta; Nicholas M. Canaris, Atlanta, both of Ga.

[73] Assignee: Vinings Industries, Inc., Atlanta, Ga.

[21] Appl. No.: 380,593

[22] Filed: Jan. 30, 1995

[51] Int. Cl.[6] ..... D21C 1/08

[52] U.S. Cl. ..... 162/76; 162/78; 162/90

[58] Field of Search ..... 162/72, 73, 78, 162/79, 80, 90, 76

[56] References Cited

U.S. PATENT DOCUMENTS 2,927,082 3/1960 Young .
3,801,512 4/1974 Solenberger .
4,619,663 10/1986 Tatin .
4,732,650 3/1988 Michalowski et al. .
4,740,212 4/1988 Yant et al. .
4,849,053 7/1989 Gentile, Jr. et al. .
4,938,842 7/1990 Whiting et al. .
4,959,075 9/1990 Baehr et al. .

*Primary Examiner*—Frank Spear
*Attorney, Agent, or Firm*—Klauber & Jackson

[57] ABSTRACT

Pulp bleaching processes employing peroxides and/or oxygen are improved by using bleaching additives, preferably before the application of the peroxide and/or oxygen. The bleaching additives contain at least one alkali metal sulfamate such as a sodium sulfamate and a polyaminocarboxylic acid such as DTPA or a salt thereof, such as sodium DTPA.

7 Claims, 1 Drawing Sheet

BLEACHING COMPOSITIONS AND PROCESSES EMPLOYING SULFAMATES AND POLYAMINOCARBOXYLIC ACIDS

BACKGROUND OF THE INVENTION

1. Field of the Invention

The present invention relates to the discovery of synergistic blends of ingredients and a process to enhance peroxide and oxygen and combinations of the two bleaching processes used for the production of paper pulps and textiles. Bleaching activity is enhanced beyond the additive effects of the individual ingredients.

2. Background and Description of the Prior Art

Bleaching of lignocellulosic materials can be divided into lignin retaining and lignin removing bleaching operations. In the case of bleaching high yield pulps like Groundwood, Thermo-Mechanical Pulp and Semi-Chemical pulps, the objective is to brighten the pulp while all pulp components including lignin are retained as much as possible. This kind of bleaching is lignin retaining. Common lignin retaining bleaching agents used in the industry are alkaline hydrogen peroxide and sodium dithionite (hydrosulfite).

Hydrogen peroxide decomposes into oxygen and water with increasing pH, temperature, heavy metal concentrations, etc. The decomposition products, radicals like HO. and HOO., lead to lower yields by oxidation and degradation of lignin and polyoses. Therefore, hydrogen peroxide is stabilized with sodium silicates and chelating agents when mechanical pulps (high yield pulps) are bleached.

The bleaching effect is achieved mainly by the removal of conjugated double bonds (chromophores), by oxidation with hydrogen peroxide (P), or reduction with hydrosulfite (Y). Other bleaching chemicals more rarely used are FAS (Formamidine Sulfinic Acid), Borohydride ($NaBH_4$), Sulfur dioxide ($SO_2$), Peracetic acid, and Peroxomonosulfate under strong alkaline conditions.

Pretreatments including electrophilic reagents such as elemental chlorine, chlorine dioxide, sodium chlorite and acid $H_2O_2$ increase the bleaching efficiency of hydrogen peroxide bleaching.

In the case of bleaching chemical pulps like kraft pulp, sulfite pulps, NSSC, NSSC-AQ, soda, organosolv, and the like, that is to say with lignocellulosic material that has been subjected to delignifying treatments, bleaching includes further lignin reducing (delignifying) reactions. Bleaching of chemical pulps is performed in one or more subsequent stages. Most common modern bleaching sequences are CEH, CEHD, CEHDED, CEDED, $C_D$EDED, $O_2C_D$EDED, $O_2DE_{PO}DEP$ and $C_DE_ODE_PD$. (C chlorination, E caustic extraction, H alkaline hypochlorite, D chlorine dioxide, $O_2$ oxygen delignification, $C_D$ chlorination substituted with chlorine dioxide, $E_O$ pressurized extraction with oxygen, $E_{OP}$ pressurized extraction with oxygen and peroxide, P peroxide, $E_P$ extraction with peroxide.)

In all of these bleaching sequences, the first two stages are generally considered as the "delignification stages". The subsequent stages are called the "final bleaching". This terminology describes the main effects that can be seen by the specific chemical treatments.

While in the first two stages the most apparent effect is the reduction of residual lignin, in the subsequent stages the most distinguishable effect is the increased brightness.

Hydrogen peroxide, oxygen, and combinations of the two bleaching compounds have been used in bleaching paper pulp and textiles for a number of years. Environmental pressure on chlorine based bleaching and the effect it has on effluent from the manufacturing process has accelerated the use of chlorine free bleaching processes to reduce the amount of dioxins and AOX, absorbable organic halides, in the effluent and bleached paper or textiles.

Oxygen bleaching is conducted under alkaline pH conditions at elevated temperature and pressure, with the process generating some peroxide in-situ during the reaction. Peroxide bleaching is also conducted under alkaline pH conditions, normally at elevated temperature. Oxygen stages are being enhanced with the addition of peroxide. There is a trend in caustic extraction stages (wash out lignins) to pressurize the stage and add oxygen or peroxide and sometimes both to enhance bleaching performance. Ozone bleaching is beginning to make an impact. All of these alternative methods are being installed or enhanced in mills to allow the reduction or elimination of the dependency on chlorine based stages.

It is well known that peroxide bleaching compounds, particularly hydrogen peroxide, require stabilization to prevent the rapid breakdown into water and oxygen induced by heavy metals. Iron, copper, and manganese ions, either in process water or bound to the bleachable material, have a catalytic effect on the breakdown of the peroxide, especially at higher alkalinity levels. This results in a loss of peroxide and a lower bleaching efficiency. Chelating agents, such as EDTA (ethylenediamine tetraacetic acid), DTPA (diethylenetriamine pentaacetic acid), gluconic acid, glucoheptanoic acid, tartaric acid, citric acid, polyphosphates, hydroxyalkanephosphonic acid, and aminoalkanephosphonic acids, along with their corresponding alkali metal salts, are well known to prevent the breakdown of peroxide by forming complexes with the metals, rendering them harmless to the peroxide. Chelating agents have been used directly in bleach liquor to stabilize the peroxide. Chelation or Q stages have also been used recently as a low pH washing stage in paper pulp bleaching to remove metals from the pulp prior to peroxide, oxygen, or ozone bleaching.

Magnesium sulfate, magnesium chloride, and magnesium oxide have a stabilizing effect on the perhydroxyl ion formed in alkaline peroxide bleaching.

$$H_2O_2+NaOH \rightarrow Na^+ + OOH^- + H_2O$$

Magnesium salts also retard the depolymerization of cellulose, which causes loss in strength, that can occur in oxygen or peroxide bleaching stages. Alkali metal silicates are also used in stabilizing peroxide bleach, but pose a significant risk in the formation of insoluble silicate scale later in the process.

U.S. Pat. No. 4,938,842 discloses a peroxide bleaching process employing magnesium sulfate, sodium silicate and a chelating agent.

U.S. Pat. No. 4,849,053 discloses a peroxide bleaching process in which pulp is pre-treated with stabilizing chemicals including magnesium salts and chelating agents such as EDTA.

U.S. Pat. No. 4,619,663 discloses stabilizing compositions (and process) for peroxide textile bleaches comprising metal chelating agents (such as diethylenetriaminepentaacetic acid) and sodium tetraborate decahydrate.

Many patents disclose the use of chelating agents such as polyaminocarboxylic acids (e.g. DPTA) in combination with other additives, but none were found using sodium gluconate (as stabilizer) therewith. No uses of sodium sulfamate were found in this context.

U.S. Pat. No. 2,927,082 discloses peroxide bleach stabilized with magnesium salt plus gluconic acid, sodium gluconate or the like.

U.S. Pat. No. 4,959,075 discloses silicate- and magnesium-free stabilizer mixtures for stabilizing aqueous peroxide bleaching baths, comprising (A) polyhydroxy and/or hydroxycarboxylic acids and their salts, (B) polyacrylic acids, and (C) polyamine and/or amine polyphosphonic acids.

U.S. Pat. No. 4,740,212 pertains to a process for bleaching cellulosic material with hypochlorous acid in the presence of nitrogen compounds such as sulfamic acid. U.S. Pat. No. 3,801,512 discloses stabilized acidic hydrogen peroxide solutions wherein sulfamic acid is utilized.

There is a continual demand for improved chlorine-free bleaching compositions and processes, particularly those which produce increased brightness in delignified pulps.

OBJECTS AND SUMMARY OF THE INVENTION

An object of this invention is to provide improved bleaching compositions and processes involving peroxides. Another object is to stabilize the hydrogen peroxide in such bleaching compositions by preventing the catalytic effect of heavy metals which may be present. A further object of the invention is to increase the bleaching effects of hydrogen peroxide.

In accordance with the present invention, these and other objects of the invention are achieved by employing small but effective amounts of a peroxide bleach additive composition comprising at least one alkali metal sulfamate such as sodium sulfamate in conjunction with a polyaminocarboxylic acid or salt thereof, such as sodium DTPA. Applicants have also found sodium DTPA to be effective with sodium gluconate, and have used such combinations commercially.

These ingredients are used in proportions which are effective to produce synergistic bleaching effects, i.e. effects which are qualitatively or quantitatively greater than would be expected from the additive effects of the individual ingredients. Although the ranges of proportions may vary with total dosage, the material to be bleached or operation conditions, the proportions can generally range from about 2:8 to about 9:1. Preferably both ingredients are added to the pulp or other material to be bleached before the introduction of the peroxide(s).

Thus, the invention further encompasses a bleaching process wherein an additive comprising at least one alkali metal sulfamate and at least one polyaminocarboxylic acid or salt thereof is added to a pulp or other material to be bleached, then at least one peroxide is added, said alkali metal sulfamate and said polyaminocarboxylic acid salt being present in quantities and proportions effective to produce synergistic bleaching effects.

Synergism, activity beyond normal expectation with blends of ingredients, has been found with combinations of sodium sulfamates and sodium DTPA. Each individual component enhances the bleaching ability of hydrogen peroxide, either through stabilization of the perhydroxyl ion or chelation of heavy metals. The results with the mixtures are beyond expectation of the activity of the individual components. Not all ratios of these active ingredients show synergism. Some ratios of actives are merely additive and others are actually antagonistic, where performance is substantially below that expected.

These synergistic combinations are further enhanced by the process of adding said mixtures to paper pulp or the like prior to the addition of hydrogen peroxide or of an alkaline peroxide liquor where the mixture is in the pulp during the bleaching process. Improved bleach response is seen with pulp addition as compared to addition of the mixture to the bleach liquor. Enhanced performance is measured by increased in pulp brightness or reductions in KAPPA number of the pulp. Activity is also better when the mixtures are added to a pulp prior to the addition of bleach rather than addition in a chelation or Q stage, with the intent of washing heavy metals out of the fiber prior to bleaching. The reason for this difference appears to relate to the available inherent magnesium concentration during the peroxide bleaching process.

Other objects and advantages of the invention will be apparent from perusal of the following detailed description, including the figures and the appended claims.

BRIEF DESCRIPTION OF THE DRAWING

The invention will be further understood with reference to the accompanying drawing, wherein.

DETAILED DESCRIPTION OF THE INVENTION

Figure 1:
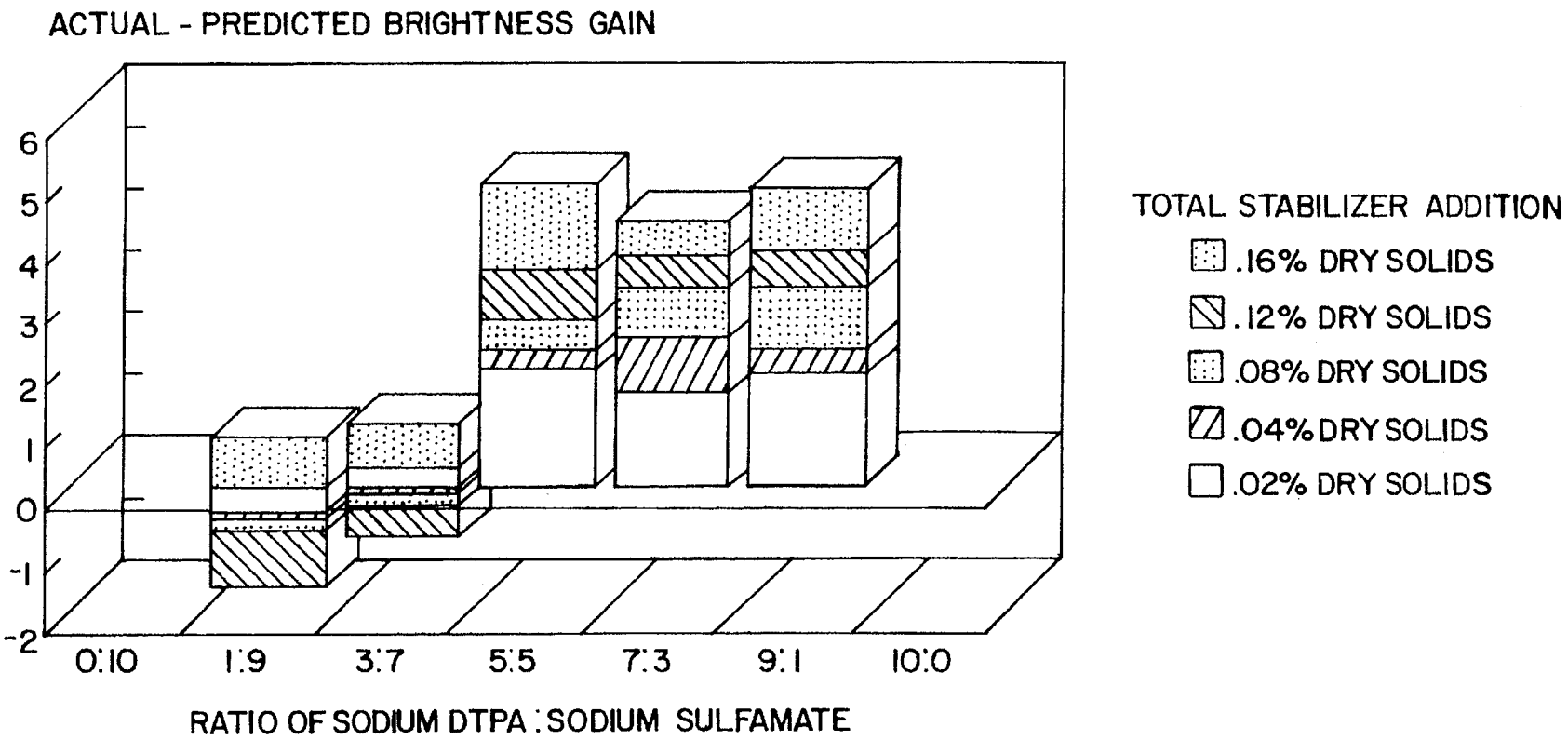
FIG. 1 is a plot illustrating the relative effects upon brightness of bleached pulp of various quantities and proportions of the active ingredients.

Lignocellulosic materials such as untreated wood, wood chips and annual plants like corn stalks, wheat straw, kenaf and the like can be used in accordance with the invention. Especially suitable is material that has been defiberized in a mechanical process, chemical processes or a combination of mechanical and chemical processes such as GW, TMP, CTMP, kraft pulp, sulfite, pulp, soda pulp, NSSC, organosolv and the like. It is the kind of material in an aqueous suspension, hereinafter referred to a pulp, which is treated in accordance with the present invention with the specified additives and subsequently in a follow on stage subjected to an oxygen and/or peroxide stage. The invention can also be practiced with any bleachable fibrous cellulosic material.

The present invention can be considered as providing a core process formed of two stages in a sequence; namely, a step of treatment with bleaching additives and a follow on stage of oxygen and/or peroxide treatment. This core sequence can be systematically represented as X—OX; viz, the "X" symbolizing the additives step and "OX" symbolizing the oxygen/peroxide step. The core sequence as defined herein can be followed by one or more additional conventional pulp handling stages such as additional oxidation, peroxide treatment steps as well as steps involving treatment with bleaching additives. Similarly, the core sequence can be preceded by one or more conventional steps such as those mentioned above.

The core sequence, X—OX, should not be interrupted by a washing cycle. It is preferred that the order of the core sequence be X—OX; that is, the additive and pulp followed by at least one oxidation stage (oxygen and/or peroxide). The importance of having the additive treatment precede an OX step resides in the fact that subsequent delignification/oxidation results are unexpectedly enhanced while retaining desirable viscosity properties.

The scope of the variations in the overall methods of treating pulp including the 2-stage sequence of the invention is very wide and can be illustrated by the following possible representative sequences.

As used herein, the symbol R represents unbleached, brown stock, A is a transition metal removing treatment, P is any peroxide compound treatment step, O is any oxygen and X—OX is the core process of the invention:

R—X—OX

R—A—X—OX

R—O—X—OX

R—A—O—X—OX

R—A—X—OX—X—OX

R—P—X—OX

R—A—P—X—OX

The above is merely illustrative and is not considered limiting.

The consistency of the pulp in the bleaching additive treatment step can range from 0.01% to 60%, preferably from 5% to 25%.

It is customary that a chemical base such as NaOH, MgO, or other suitable alkaline material be added to the pulp in order to control the acidity at a desired pH level. Any suitable alkaline material can be used to control acidity provided it does not adversely effect the process or product. Any sequence of chemical addition of pH controlling alkali and additives in the first step, including the simultaneous addition, can be carried out. The starting pH is not narrowly critical. The starting pH can be 1 to 11. Preferably, the starting pH of the pulp for the X stage (after addition of caustic and addition of additives) is between 7 and 11. It is to be noted that the pH profile over the course of the X stage has been determined to be subject to wide variation and is not narrowly critical.

Trials have shown that the X-stage treatment (additive stage) is very little affected by temperature; that is, the reaction is not very temperature dependent. Thus, the bleaching additive treatment step is effective at low temperatures such as 5 degrees C. as well as at temperatures of up to 100 degrees C. Preferable temperatures for the additive treatment are in the range of 40 degrees C. to 70 degrees C.

Depending on temperature, pH and chemical charge the residence time required is typically between 1 second up to 10 hours, frequently 1 minute to 2 hours, although the upper time limit is not critical. Thus, for example the retention time varies as to how long the pulp takes to pass through the conventional bleaching tower, high intensity mixing zone or the like. Some parts of the pulp may move through rapidly; e.g. ½ hour, while other parts of the pulp may take 24 hours or longer to pass through. Accordingly, the process of the invention is not dependent on a narrow range of time parameters. Uniform distribution of the additive is imperative to treat all the fiber to obtain the best results. Addition of dilution water with the additive prior to addition to pulp followed by high shear mixing, such as in a centrifugal stock pump, gives best results.

It is to be noted that the bleaching additive stage can be applied to any kind of treated (bleached) or untreated (e.g. brown stock) pulp. Advantageously, one or more heavy metal and organic contaminants eliminating process steps can be initially carried out at pretreatment to favorably impact the delignification efficiency of the aforesaid stage.

Pressure conditions for the X-stage can vary for this process as is conventional in pulp operations. Typically, from atmosphere to 0.5 MPa is suitable.

The treatment stage in which bleaching additives are used can be designated by the symbol "X". The new process which is the subject of this invention features a combined application of the X stage with any other kind of oxygen and/or peroxide stage, generally described by the symbol (OX). The new process can be abbreviated by "X—(OX)" whereby "(OX)" can stand for O (oxygen delignification), Eo, Ep, Eop, Eoh (extraction stages reinforced with oxygen, peroxide, oxygen and peroxide as well as oxygen and hypochlorite respectively), and P (peroxide stage). Although hypochlorite has been mentioned as a possible optional stage that can be used in combination with the X—OX process of the invention after the OX stage, efforts are being made in the industry to eliminate the use of chlorine chemicals whenever possible.

The process of the invention can be used repeatedly and in combination with the bleaching stages commonly used in order to delignify and bleach to required levels. The two treatments, step X and step (OX) should be conducted without intermediate washing. It is indispensable that the X step is performed prior to at least one (OX) step.

It is an object of this invention to employ at least two bleaching additives A and B in quantities and proportions effective to produce synergistic bleaching effects; that is, to produce increases in brightness or other measures of bleaching effects which are more than the combined expected effects of the separate additives. The optimum total quantities will vary with the type of pulp or other stock to be bleached, operating conditions, etc. but generally the total quantity will be a small but effective amount in the range of from about 0.02 to 0.4 weight percent of the pulp. Preferably, the amount ranges from 0.04 to 0.2 weight percent, and most preferably it is 0.08 to 0.16 weight percent. For a given total quantity the proportions are those which produce a synergistic bleaching effect, preferably maximizing said effect. Such proportions of A:B can range from about 1:1 to 9:1, preferably from about 2:8 to 9:1, and most preferably from about 5:5 to about 9:1. The proportions of A:B are less critical at the higher total additive dosages.

Additive A is a polyaminocarboxylic acid such as diethylenetriamine pentacetic acid (DTPA), ethylenediamine tetraacetic acid (EDTA) or hydroxyethylenediaminetetraacetic acid (HEDTA).

The ammonium or alkali metal salts, such as the sodium salt, are presently preferred. Ammonium salts can be used if there are no subsequent chlorine-based stages.

Additive B is an alkali metal sulfamate such as sodium sulfamate, with ammonium, lithium and potassium sulfamates also being useful. As above, ammonium sulfamate can be used if there are no subsequent chlorine-based stages.

EXAMPLES

The invention is further illustrated by the following non-limiting examples.

LABORATORY METHODS

All laboratory bleaching tests were run on a softwood kraft pulp, obtained from a mill in the southern United States, which had been partially bleached through an oxygen delignification stage followed by a chlorine dioxide stage. All samples were taken from a single batch of pulp. Weighed pulp samples were treated with the appropriate dosage of the synergistic bleach enhanced mixtures of the base materials, mixed at high shear for good distribution, caustic (NaOH at 2.20% on 100% active basis) and peroxide ($H_2O_2$ at 1.5% on 100% active basis) added, mixed at high shear again for good distribution, sealed in a polyethylene bag, and placed in an ultrasonic bath at constant temperature for continuous mixing throughout the bleaching process. Tests were run at 80 degrees C. for 60 minutes. The samples were then removed from the bath, and 3.0 g handsheets were prepared from the pulp using a British sheet mold. The hand sheets were pressed according to standard TAPPI methods and air dried overnight.

Brightness measurements on the finished handsheets were determined on an Elrepho 2000 Datacolor system. Brightness was measured at a wavelength of 457 nm and is reported in all cases as % ISO brightness. The reported brightness value is an average of 5 replicates on each sheet. The entire laboratory process is quite reproducible, with the standard deviation on 6 replicates of the bleaching and measurement process at 0.25% ISO measured to two decimal places.

This laboratory method has been shown to produce excellent correlation to actual results in mill conditions with the same chemical dosages.

SYNERGISM CALCULATION

Samples of the combinations were tested in the following ratios of component A to component B: 0:10, 1:9, 3:7, 5:5, 7:3, 9:1, 10:0. The total active solids content was kept constant at each indicated dosage (0.02% to 0.16% by weight of dry fiber) in the TABLES.

NOMENCLATURE

3:7 at 0.02% means in this discussion that a total of 0.02% active solids (excludes waters of hydralion) are used to treat the pulp, and components A and B are combined in a ratio of 3 parts of A to 7 parts of B. The brightness gains provided by component A alone (10:0) and component B alone (0:10) at 0.02% active solids are used as reference points to determine if synergism between actives is genuine.

Gain(actual)–Proportional Gain(Component *A*)–Proportional Gain-(Component *B*)=Difference from Expected.

Gain(actual)–30% Gain(Component *A*)–70% Gain(Component *B*)=Difference from Expected.

If the difference from expected was positive, the synergism between actives was considered genuine and the performance better than expected. If the difference was zero, the performance was merely additive. If the difference was a negative number, there was antagonism between the actives and performance was worse than expected.

Table I sets forth the proportions of sodium DTPA (A) and sodium sulfamate (B) employed in successive trials at various dosage levels. Each proportion ratio is designated a numbered example, with letters assigned to each dosage level for that proportional ratio. The measured brightness gains for these examples are also presented in Table I. Table II presents the results of calculations to determine the brightness difference which each example represents in comparison to the expected additive effects of the sodium DTPA and sodium sulfamate.

FIG. 1 presents the results of Table II graphically. It can be seen that for most dosages, synergistic effects were obtained for proportions of A:B including 5:5, 7:3 and 9:1, with some synergistic effects obtained at 1:9 and 3:7 at the highest dosages. Extrapolating and simplifying, it can be seen that synergistic effects can be expected for proportional ratios of polyaminocarboxylic acids or salts thereof to sulfamates ranging from about 4:6 to about 9:1, preferably from about 5:5 to about 9:1, or from about 1:9 to about 9:1 at the higher dosages.

TABLE I

| Example No. | INGREDIENT | Actives Ratio | A Brightness 0.02% Act. | B Brightness 0.04% Act. | C Brightness 0.08% Act. | D Brightness 0.12% Act. | E Brightness 0.16% Act. | A Brightness Gain 0.02% Act. | B Brightness Gain 0.04% Act. | C Brightness Gain 0.08% Act. | D Brightness Gain 0.12% Act. | E Brightness Gain 0.16% Act. |
|---|---|---|---|---|---|---|---|---|---|---|---|---|
| 1 | Na DTPA :NaSulfamate | 0:10 | 68.1 | 68.2 | 68.3 | 68.8 | 67.5 | 1.2 | 1.3 | 1.4 | 1.9 | 0.6 |
| 2 | Na DTPA :NaSulfamate | 1:9 | 67.6 | 68.2 | 68.3 | 68.1 | 68.6 | 0.7 | 1.3 | 1.4 | 1.2 | 1.7 |
| 3 | Na DTPA :NaSulfamate | 3:7 | 68.2 | 68.5 | 68.6 | 68.8 | 69.2 | 1.3 | 1.6 | 1.7 | 1.9 | 2.3 |
| 4 | Na DTPA :NaSulfamate | 5:5 | 69.7 | 69.2 | 69.6 | 70.4 | 70.5 | 2.8 | 2.3 | 2.7 | 3.5 | 3.6 |
| 5 | Na DTPA :NaSulfamate | 7:3 | 69.2 | 70.0 | 70.2 | 70.4 | 70.4 | 2.3 | 3.1 | 3.3 | 3.5 | 3.5 |
| 6 | Na DTPA :NaSulfamate | 9:1 | 69.3 | 69.8 | 70.7 | 70.8 | 71.5 | 2.4 | 2.9 | 3.8 | 3.9 | 4.6 |
| 7 | Na DTPA :NaSulfamate | 10:0 | 67.5 | 69.5 | 69.9 | 70.3 | 70.8 | 0.6 | 2.6 | 3.0 | 3.4 | 3.9 |

TABLE II

| Example No. | INGREDIENT | Actives Ratio | A Actual Gain Additive Effect 0.02% Act. | B Actual Gain Additive Effect 0.04% Act. | C Actual Gain Additive Effect 0.08% Act. | D Actual Gain Additive Effect 0.12% Act. |
|---|---|---|---|---|---|---|
| 1 | Na DTPA :NaSulfamate | 0:10 | 0.0 | 0.0 | 0.0 | 0.0 |
| 2 | Na DTPA :NaSulfamate | 1:9 | −0.4 | −0.1 | −0.2 | −0.9 |
| 3 | Na DTPA :NaSulfamate | 3:7 | 0.3 | −0.1 | −0.2 | −0.5 |
| 4 | Na DTPA :NaSulfamate | 5:5 | 1.9 | 0.3 | 0.5 | 0.8 |
| 5 | Na DTPA :NaSulfamate | 7:3 | 1.5 | 0.9 | 0.8 | 0.5 |
| 6 | Na DTPA :NaSulfamate | 9:1 | 1.8 | 0.4 | 1.0 | 0.6 |
| 7 | Na DTPA :NaSulfamate | 10:0 | 0.0 | 0.0 | 0.0 | 0.0 |

| Example No. | E Actual Gain Additive Effect 0.16% Act. | A % Difference from Additive Effect 0.02% Act. | B % Difference from Additive Effect 0.04% Act. | C % Difference from Additive Effect 0.08% Act. | D % Difference from Additive Effect 0.12% Act. | E % Difference from Additive Effect 0.16% Act. |
|---|---|---|---|---|---|---|
| 1 | 0.0 | 0.0% | 0.0% | 0.0% | 0.0% | 0.0% |
| 2 | 0.8 | −38.4% | −9.1% | −10.1% | −41.6% | 82.8% |
| 3 | 0.7 | 28.7% | −5.3% | −9.1% | −19.5% | 44.7% |
| 4 | 1.4 | 217.0% | 17.9% | 23.7% | 31.2% | 60.0% |
| 5 | 0.6 | 204.0% | 40.3% | 32.2% | 17.7% | 20.3% |
| 6 | 1.0 | 281.0% | 17.4% | 35.2% | 18.9% | 28.9% |
| 7 | 0.0 | 0.0% | 0.0% | 0.0% | 0.0% | 0.0% |

While the present invention has been set forth in terms of specific embodiments thereof, it will be understood in view of the instant disclosure, that numerous variations upon the invention are now enabled to those skilled in the art, which variations yet reside within the scope of the present teaching. Accordingly, the invention is to be broadly construed and limited only by the scope and spirit of the claims now appended thereto.

What is claimed is:

1. A pulp bleaching process comprising the steps of:

(a) adding to the pulp to be bleached a composition consisting essentially of a polyaminocarboxylic acid or salt thereof and an alkali metal sulfamate; and (b) treating the pulp resulting from step (a) under alkaline pH conditions with at least one bleach selected from the group consisting essentially of peroxides, oxygen and mixtures thereof.

2. The process of claim 1 wherein said sulfamate is a sodium sulfamate and said polyaminocarboxylic acid is DTPA.

3. The process of claim 2 wherein said DTPA is present as the sodium salt.

4. The process of claim 1 wherein the total quantity of said composition is in the range of from about 0.02 to about 0.4 weight percent of said pulp.

5. The process of claim 4 wherein said total quantity of composition ranges from 0.04 to 0.2 weight percent of said pulp.

6. The process of claim 1 wherein the polyaminocarboxylic acid or salt thereof and alkali metal sulfamate are present in the composition in a ratio in the range of from about 1:9 to about 9:1.

7. The process of claim 6 wherein the ratio is in the range of from about 4:6 to about 9:1.

* * * * *